US006171086B1

(12) United States Patent
Lifson et al.

(10) Patent No.: US 6,171,086 B1
(45) Date of Patent: Jan. 9, 2001

(54) SCROLL COMPRESSOR WITH PRESSURE EQUALIZATION GROOVE

(75) Inventors: Alexander Lifson, Manlius; James W. Bush, Skaneateles, both of NY (US)

(73) Assignee: Carrier Corporation, Syracuse, NY (US)

( * ) Notice: Under 35 U.S.C. 154(b), the term of this patent shall be extended for 0 days.

(21) Appl. No.: 08/963,040

(22) Filed: Nov. 3, 1997

(51) Int. Cl.[7] ..... F01C 1/02
(52) U.S. Cl. ..... 418/55.2; 418/75
(58) Field of Search ..... 418/55.1, 55.2, 418/75

(56) References Cited

U.S. PATENT DOCUMENTS

| | | | | |
|---|---|---|---|---|
| 3,874,827 | | 4/1975 | Young . | |
| 4,417,863 | | 11/1983 | Ikegawa et al. | 418/55 |
| 4,441,870 | | 4/1984 | Ikegawa et al. | 418/55 |
| 4,464,100 | | 8/1984 | Machida et al. | 418/55 |
| 4,468,178 | | 8/1984 | Hiraga et al. | 417/440 |
| 4,678,415 | | 7/1987 | Hirano et al. | 418/50 |
| 4,856,973 | | 8/1989 | Hirano et al. | 418/55 |
| 5,037,279 | | 8/1991 | Suefuji et al. | 418/55.2 |
| 5,151,020 | | 9/1992 | Mori et al. | 418/55.2 |
| 5,171,141 | * | 12/1992 | Morozumi et al. | 418/55.2 |
| 5,370,512 | | 12/1994 | Fujitani et al. | 418/55.2 |
| 5,421,707 | * | 6/1995 | Daniels | 418/55.2 |
| 5,462,419 | * | 10/1995 | Hill et al. | 418/55.6 X |
| 5,722,257 | * | 3/1998 | Ishii et al. | 418/55.5 X |
| 5,873,711 | * | 2/1999 | Lifson | 418/55.2 |

FOREIGN PATENT DOCUMENTS

| | | | | |
|---|---|---|---|---|
| 3626796 | * | 4/1987 | (DE) | 418/55.1 |
| 0043702A2 | | 1/1981 | (EP) . | |
| 0508293A1 | | 1/1992 | (EP) . | |
| 403225093 | * | 10/1991 | (JP) | 418/55.1 |
| 08200255 | | 6/1996 | (JP) . | |

OTHER PUBLICATIONS

Japanese Patent Abstract 07293459 A dated Jul. 11, 1995.
Japanese Patent Abstract 06107402 dated Jul. 11, 1995.
Japanese Patent Abstract 07023304 dated Jun. 8, 1996.

* cited by examiner

*Primary Examiner*—Hoang Nguyen
(74) *Attorney, Agent, or Firm*—Carlson, Gaskey & Olds

(57) ABSTRACT

A scroll compressor is provided with a pressure equalization groove in the base of one of the scroll members. The pressure equalization groove communicates between the compression chambers at an intermediate pressure. Thus, should one of the two compression chambers be at higher pressure than the other, pressure is equalized. The invention eliminates mixing losses which would otherwise occur when two chambers of differing pressures communicate with each other or at discharge. Vibration and noise are also reduced.

9 Claims, 1 Drawing Sheet

SCROLL COMPRESSOR WITH PRESSURE EQUALIZATION GROOVE

BACKGROUND OF THE INVENTION

This invention relates to a scroll compressor with a groove connecting between two compression chambers at a point in the compression cycle prior to communication to the discharge port, but after the chambers have been sealed.

Scroll compressors are becoming widely utilized for refrigerant compression applications. As known, interfitting orbiting and fixed scroll wraps define a plurality of compression chambers. Typically, two compression chambers are concurrently sealed and moved through intermediate pressures to a discharge port. The compression chambers are not always equally spaced about a center line of the scroll compressor, and thus there may be some asymmetry to the forces from the compressed fluid.

Moreover, it is possible that one of the two chambers may have a slightly higher pressure than the other. This could occur as an example if one of the two chambers has a higher volume of fluid entrapped on a particular cycle. Eventually, the two chambers merge together and communicate with the discharge port. If there is a pressure imbalance at communication, there may be mixing losses as fluid in the higher pressure chamber mixes with fluid in the lower pressure chamber. Such mixing losses decrease the efficiency of the scroll compressor. Further, the differential pressures can result in vibration, noise, and, for example, excessive loading of the anti-rotation coupling which holds the scroll members in alignment.

SUMMARY OF THE INVENTION

In a disclosed embodiment of this invention, a pressure equalization groove communicates between two scroll compression chambers after they have been sealed from suction, but prior to merging and being communicated to the discharge port. The communication ensures the two chambers are at similar pressures when they merge and communicate with the discharge port.

In a preferred embodiment of this invention, the scroll compressor may be utilized with economizer injection ports. Economizer ports extend through the fixed scroll to supply fluid to a compression chamber. The economizer port increases the mass of refrigerant trapped in each compression chamber. Preferably the pressure equalization groove does not communicate between the compression chambers until a point just before or after the chambers have moved beyond the economizer ports. If groove communication between the compression chambers ends prior to merging of the chambers and communication with the discharge port, the groove may not ensure proper pressure balance.

In one embodiment, the pressure equalization groove is formed in the base of the fixed scroll. In a second embodiment the pressure equalization groove is formed in the base of the orbiting scroll. Also, grooves can be formed in both scrolls.

These and other features of the present invention can be best understood from the following specification and drawings, of which the following is a brief description.

DETAILED DESCRIPTION OF A PREFERRED EMBODIMENT

Figure 1:
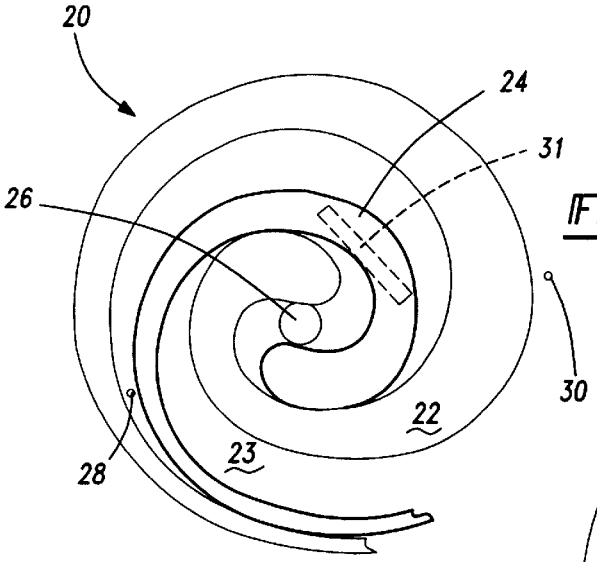
FIG. 1 shows a scroll compressor which incorporates the present invention.

A scroll compressor 20 as shown in FIG. 1 incorporates a fixed scroll 22 having a wrap extending from a base 23. The fixed scroll wrap interfits with a wrap from an orbiting scroll 24 to define compression chambers. As known, the orbiting scroll moves relative to the fixed scroll to first seal and then compress fluid trapped in compression chambers. The compression chambers move towards a point where they merge together and communicate with a discharge port 26 generally positioned on or near a center line of fixed scroll 22. Economizer injection ports 28 and 30 extend through the base of the fixed scroll to inject supplemental fluid to the compression chambers. Ports 28 and 30 are preferably positioned at a location such that they first communicate with the compression chambers at a point approximately equal to the time when the orbiting scroll first seals the compression chamber. A pressure equalization groove 31 is formed in the base 23 of the fixed scroll 22. In the position illustrated in FIG. 1, pressure equalization groove 31 is closed off by the wrap of the orbiting scroll.

Figure 2:
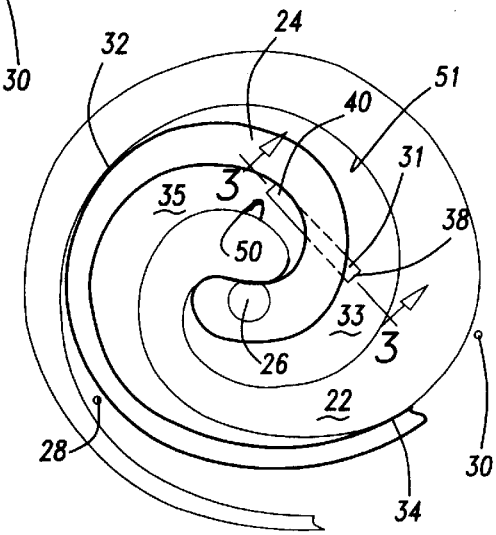
FIG. 2 shows a scroll compressor at a point where a pressure equalization groove communicates the opposed compression chambers.

FIG. 2 shows a position in the cycle of the orbiting scroll 24 at a location where the sealing points have moved beyond the location where the economizer ports 28 and 30 communicate with the compression chambers. As shown in FIG. 2, a compression chamber 33 is defined between the orbiting scroll 24 and the fixed scroll 22 from a sealing point 32 forwardly to a point where the walls of the scroll wraps also contact. At the point illustrated in FIG. 2 the tip of the orbiting scroll 24 covers the discharge port 26. Thus, the compression chamber 33 is at an intermediate pressure in the illustrated position. A second sealing point 34 defines a second compression chamber 35 forwardly to another contact point between the wrap walls.

In the position shown in FIG. 2, the compression chambers 33 and 35 are sealed and are being moved forwardly in the orbiting cycle of the orbiting scroll 24. Eventually chambers 33 and 35 will merge together and communicate with discharge port 26. In the prior art, it was possible that one of the compression chambers 33 or 35 would be at a higher pressure. The pressure imbalance could result in mixing losses when the two chambers 33 and 35 eventually merge together. A pressure imbalance could also result in vibration and undesirable noise or high stress on the compressor mechanism.

As can be seen, pressure equalization groove 31 is formed generally between an outward-facing wrap portion 50 of the fixed scroll and an opposed inward-facing wrap portion 51 of the fixed scroll. Groove 31 has first end 38 communicating with chamber 33 in the illustrated position and a second end 40 communicating with chamber 35.

Figure 3:
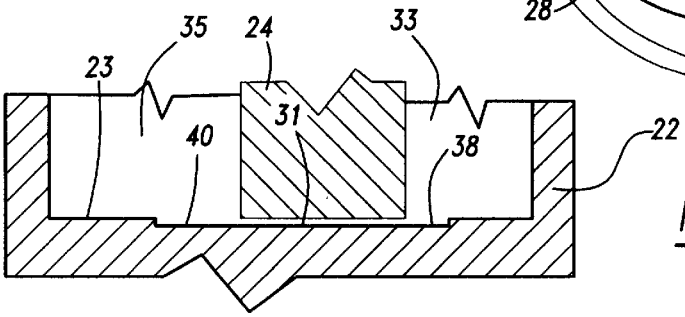
FIG. 3 is a partial view through FIG. 2.

As shown in FIG. 3, the groove 31 is formed into the face of the base 23 and communicates between chambers 33 and 35 through ends 38 and 40. The groove preferably has a depth of 10 millimeters or less. In one embodiment, the groove 31 has a depth of around 100 microns. More preferably, the groove has a depth between 1 millimeter and 5 millimeters.

When a pressure imbalance exists between the chambers 33 and 35, the pressure will equalize once ends 38 and 40 communicate with the chambers. Vibration and noise will be reduced. Further, when the two chambers do fully mix with each other when they merge there will be no mixing losses since chambers 33 and 35 are at equal pressures.

The present invention thus improves the operation of the scroll compressor and increases efficiency.

Figure 4:
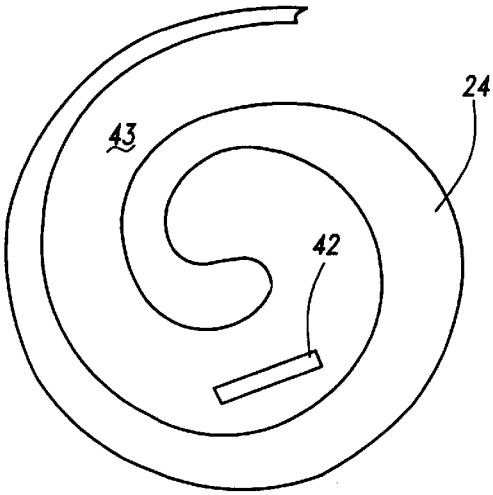
FIG. 4 is an end view of an orbiting scroll in one embodiment of this invention.

FIG. 4 shows another embodiment wherein a pressure equalization groove 42 is formed in the base 43 of the orbiting scroll 24. Groove 42 is positioned such that it communicates between the chambers 33 and 35 at a similar time as in the prior embodiment. The groove 42 preferably has a depth similar to the depth of the groove 31. A groove 31 in the fixed scroll and a groove 42 in the orbiting scroll may be used in combination.

In a method of operating a scroll compressor according to this invention, a pressure equalization groove is formed in the base of at least one of the fixed and orbiting scrolls. The pressure equalization groove is positioned such that it communicates between two spaced compression chambers at a location prior to the compression chambers being merged together and being communicated to the discharge port, but after the compression chambers are initially sealed. In a preferred embodiment, the position is selected such that the pressure equalization groove does not communicate between the chambers until the scroll members have moved near the location where the compression chambers are closed from the economizer ports.

A preferred embodiment of the present invention has been disclosed, however, a worker of ordinary skill in the art would recognize certain modifications would come within the scope of this invention. For that reason the following claims should be studied to determine the true scope and content of this invention.

What is claimed is:

1. A scroll compressor comprising:

a non-orbiting scroll having a base and a spiral wrap extending from said base;

an orbiting scroll having a base and a spiral wrap extending from said base, said wraps of said non-orbiting and orbiting scrolls interfitting, said orbiting scroll being driven for orbital movement relative to said non-orbiting scroll such that said wraps of said non-orbiting and orbiting scroll cyclically interacting with each other to define seal points separating compression chambers, and movement of said orbiting scroll wraps moving said compression chambers inwardly to communicate with a central discharge port, with at least two of said compression chambers eventually communicating with each other and said discharge port; and a pressure equalization groove having two opposed ends and formed in an outer face of the base of at least one of said non-orbiting and orbiting scrolls, said outer face facing the other of said other non-orbiting and orbiting scrolls a first of said ends selectively communicating with one of said two compression chambers and a second of said ends selectively communicating with the other of said two compression chambers at a location after said orbiting scroll has interacted with said non-orbiting scroll to seal said two compression chambers, and prior to said two compression chambers being communicated to each other and said discharge port.

2. A scroll compressor as recited in claim 1, wherein economizer injection ports extend through said base of said non-orbiting scroll to supply additional fluid to said compression chambers, and said pressure equalization groove communicates between said two compression chambers during a time subsequent to said orbiting scroll moving beyond said economizer injection ports.

3. A scroll compressor as recited in claim 2, wherein said pressure equalization groove is formed in said base of said non-orbiting scroll.

4. A scroll compressor as recited in claim 3, wherein a pressure equalization groove is also formed in said base of said orbiting scroll.

5. A scroll compressor as recited in claim 1, wherein said pressure equalization groove is formed in said base of said orbiting scroll.

6. A scroll compressor as recited in claim 1, wherein said pressure equalization groove is formed in said base of said non-orbiting scroll.

7. A scroll compressor as recited in claim 1, wherein said pressure equalization groove is formed of a depth of between 100 microns and 10 millimeters.

8. A scroll compressor comprising:

a non-orbiting scroll having a base and a generally spiral wrap extending from said base;

an orbiting scroll having a base and a generally spiral wrap extending from said base, said orbiting scroll being driven for orbital movement relative to said non-orbiting scroll such that said wraps of said non-orbiting and orbiting scroll interfit and together form sealed compression chambers and move said compression chambers inwardly to communicate with a central discharge port, said orbiting scroll wrap being operable to initially interact with the non-orbiting scroll wrap to define seal points defining a plurality of compression chambers, with at least two of said compression chambers being moved toward aid discharge port concurrently, said two compression chambers eventually communicating with each other and said discharge port; and a pressure equalization groove formed in an outer face of the base of said non-orbiting scroll, said outer face being defined as facing said orbiting scroll, said pressure equalization groove having opposed ends, with a first end selectively communicating with one of said two compression chambers and a second end selectively communicating with the other of said two compression chambers at a location after said orbiting scroll has interacted with said non-orbiting scroll to seal said two compression chambers, and prior to said two compression chambers being communicated with each other and to said discharge port.

9. A method of operating a scroll compressor comprising the steps of:

1. providing a non-orbiting and an orbiting scroll, both said non-orbiting and orbiting scrolls having a base and a spiral scroll wrap extending from said base, said spiral scroll wraps of said non-orbiting and orbiting scroll interfitting to define compression chambers, and providing a pressure equalization groove in an outer face of said base of at least one of said non-orbiting and orbiting scroll wraps, said outer face being defined as facing the other of said non-orbiting and orbiting scroll wraps;

(2) causing said orbiting scroll to move relative to said non-orbiting scroll, said orbiting scroll wrap interacting with said non-orbiting scroll wrap to seal at least two compression chambers and moving said compression chambers towards a central discharge port;

(3) communicating said two compression chambers with each other through said pressure equalization groove at a point subsequent to said scroll wraps sealing and defining said compression chambers, but prior to said compression chambers communicating with each other and said discharge port; and (3) then communicating said compression chambers to each other and to said discharge port.

* * * * *